US008220798B2

(12) United States Patent
Finnochio

(10) Patent No.: US 8,220,798 B2
(45) **Date of Patent: *Jul. 17, 2012**

(54) PLAYER KEY FOR AN INSTANT-WIN LOTTERY TICKET AND METHOD FOR VALIDATING SAME

(75) Inventor: Richard Finnochio, Everett, MA (US)

(73) Assignee: GTECH Rhode Island Corporation, Providence, RI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/017,775

(22) Filed: Jan. 31, 2011

(65) Prior Publication Data

US 2011/0121511 A1 May 26, 2011

Related U.S. Application Data

(63) Continuation of application No. 12/082,152, filed on Apr. 8, 2008, now Pat. No. 7,922,178, which is a continuation of application No. 10/770,892, filed on Feb. 2, 2004, now Pat. No. 7,357,393.

(51) Int. Cl.
*A63F 3/06* (2006.01)

(52) U.S. Cl. ..... 273/139; 283/901; 283/903

(58) Field of Classification Search ..... 273/139, 273/269; 283/901, 903

See application file for complete search history.

(56) References Cited

U.S. PATENT DOCUMENTS

| | | | |
|---|---|---|---|
| 4,174,857 | A | 11/1979 | Koza |
| 4,725,079 | A | 2/1988 | Koza et al. |
| 5,074,566 | A | 12/1991 | Desbiens |
| 5,494,317 | A | 2/1996 | Johnson |
| 6,145,885 | A | 11/2000 | Scrymgeour et al. |
| 6,308,991 | B1 | 10/2001 | Royer |
| 6,309,298 | B1 | 10/2001 | Gerow |
| 6,347,794 | B2 | 2/2002 | Scrymgeour et al. |
| 7,059,514 | B1 | 6/2006 | Peters |
| 2003/0030211 | A1 | 2/2003 | Brown |
| 2004/0108653 | A1 | 6/2004 | Such |
| 2004/0227000 | A1 | 11/2004 | Behm et al. |
| 2005/0258596 | A1 | 11/2005 | Such |

OTHER PUBLICATIONS

Trade Products, Inc. (TPI) 5-Window Pull Table Catalog "Win-Code" and "EZ Paycode", inside front cover page, 1996.

*Primary Examiner* — Benjamin Layno
(74) *Attorney, Agent, or Firm* — Sullivan & Worcester LLC; Christopher T. McWhinney

(57) ABSTRACT

A game ticket is disclosed. The game ticket includes a first and second indicia concealed by a removable opaque covering and indicating visually whether the game ticket is a winning ticket. The first indicia is located with a game play area. The second indicia includes a first player key located within the game player area and a second player key located in a customer key area, wherein whether the game ticket is a winning ticket is determinable upon a comparison of the first and second player keys. A method and apparatus for using the game ticket is also disclosed.

20 Claims, 12 Drawing Sheets

PLAYER KEY FOR AN INSTANT-WIN LOTTERY TICKET AND METHOD FOR VALIDATING SAME

CROSS REFERENCE TO RELATED APPLICATIONS

The present application is a continuation of U.S. patent application Ser. No. 12/082,152, filed Apr. 8, 2008, now U.S. Pat. No. 7,922,178 which in turn is a continuation of and claims priority under 35 U.S.C. §120 to U.S. patent application Ser. No. 10/770,892, filed Feb. 2, 2004, now U.S. Pat. No. 7,357,393, the entire disclosures of which are herein expressly incorporated by reference.

A portion of the disclosure of this patent document contains material which is subject to copyright protection. The copyright owner has no objection to the facsimile reproduction by anyone of the patent document or patent disclosure as it appears in the Patent and Trademark Office patent file or records, but otherwise reserves all copyright rights whatsoever.

BACKGROUND INFORMATION

Lottery game tickets are frequently sold in retail establishments such as convenience stores, liquor stores, and the like. These and other establishments selling lottery tickets are sensitive to the costs of counter space used, and labor required in the sale and redemption of lottery tickets.

Some lottery customers do not want to wait for a weekly or daily drawing. These customers may purchase "instant-win" lottery tickets. Such tickets may also involve games, such as lotto, battleship, bingo, or other games that increase customer interest and enjoyment in the purchase of such tickets. Instant-win lottery tickets are generally sold to retailers in pre-printed books or bundles. A pre-printed ticket may have a printed indicia or message indicating the ticket is a winner and/or the prize amount, as well as human or machine-readable codes for authenticating winning tickets. These indicia, messages, and codes may be hidden, e.g., with a peel-off or scratch-off coating. Commonly, whether an instant-win ticket is a winner is predetermined prior to the sale of the ticket.

Particularly for more complicated games, purchasers and/or players of instant-win lottery tickets may have difficulty in determining the win or non-win status of their purchased tickets. For example, after removing the peel-off or scratch-off coating, instant-win lottery ticket players may have difficulty in determining from the indicia printed on the ticket whether the ticket is a winning ticket or a losing ticket. Such may be particularly the case, when, for example, the game and/or its rules are complicated. Consequently, a high percentage of winning tickets may not be redeemed, which may be problematic for lottery operators since lotteries may have statutorily regulated payouts. Also, winning tickets may encourage winners to play again repeatedly.

Players may wish to confirm the win or non-win status of their tickets by returning them to retailers who may process the tickets, for example, via a machine readable device to be certain of the ticket's status. However, retailers may not want to spend excessive amounts of time dealing with redemptions of tickets that are not actually winners and may mistreat customers who return such tickets so that they are discouraged from future playing. Therefore, it is desirable to minimize the amount of time retailers spend confirming the win or non-win status of tickets. At the same time lottery providers want to insure that lotteries are protected from fraud, including fraud by retailers. Accordingly, efficient and reliable approaches to ticket redemption and/or ticket status confirmation may be desirable

DETAILED DESCRIPTION OF EXAMPLE EMBODIMENTS

Figure 1A:
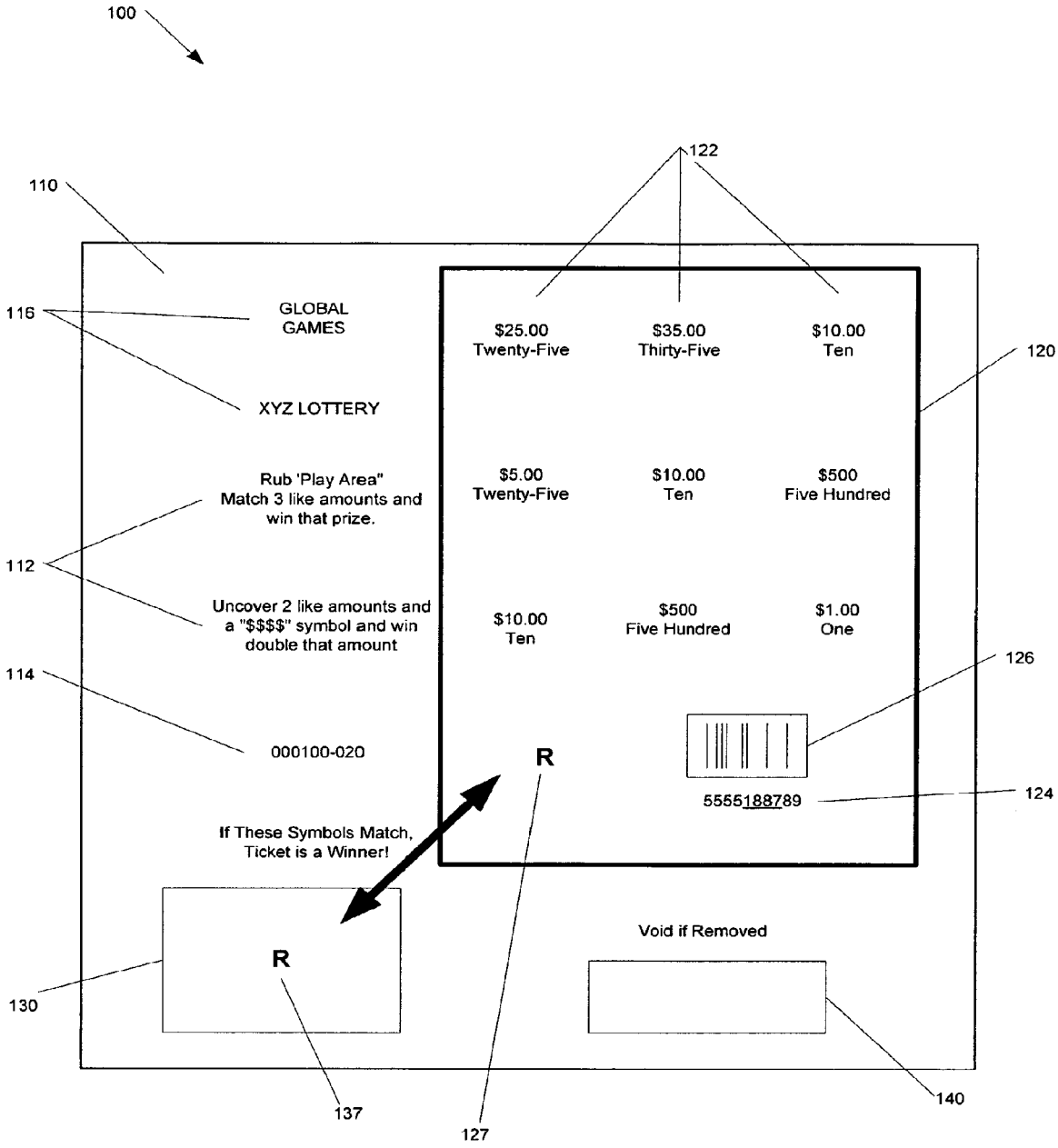
FIG. 1A illustrates an example lottery ticket, according to an example embodiment of the present invention.

FIG. 1 illustrates an example lottery ticket 100, according to an example embodiment of the present invention. The example lottery ticket 100 may be for an instant-win lottery game. Instant-win games differ from pooled drawing games, where a lottery ticket represents a chance in a drawing to be held at some later time for a pooled prize or prizes. Rather, in an instant-win game, whether the ticket is a winner is determined at or before the time the ticket is purchased, although whether the ticket is actually a winner may be concealed from both the buyer and seller.

Instant-win games may include "extended play" features such as games printed on the ticket, e.g., bingo or number matching. These features may increase the enjoyment and interest level of purchasers of such tickets, causing them to buy tickets in greater numbers or more frequently. It will be appreciated that the example ticket may also be used for other forms of games, e.g., for promotional games such as those used in direct mail or at fast food restaurants.

The example lottery ticket 100 illustrated in FIG. 1 may be located on a substrate, e.g., a printable substrate such as paper, card stock, plastic, or various laminates. Information may be found on both sides of the example lottery ticket 100. The obverse side of the ticket 100 shown in FIG. 1 may include a non-play area 110, a play area 120, and a customer key area 130 located within the non-play area 110 and/or the play area 120.

The non-play area 110 may include information not directly involved in the play of the "extended play" game provided on the ticket. Located on the non-play area may be instructions 112 for playing the extended play game, or for the use and/or redemption of the ticket. The non-play area 110 may include a card series identifier 114 that may identify the game and type of ticket. The card series identifier 114 may be used by the retailer in inventory control and/or other point of sale purposes. The non-play area 110 may also include logos or advertising information 116, e.g., identifying the provider of the game such as a state lottery, as well as a "void if removed" area which includes authentication and/or validation information intended to be concealed from the purchaser and/or player.

The play area 120 may include game information 122. The game information 112 may be examined by a ticket purchaser in light of the rules of the game to determine whether the ticket is a winner, and if so the winning amount. The play area 120 may include a numeric code 124. More digits may be provided for greater security. The numeric code 124 may include part of the information needed to authenticate the ticket when the ticket is redeemed. Portions of the numeric code 124 may be highlighted, by underlining them as illustrated, or by other approaches, e.g., placing a black box around or a colored box over the numbers to be highlighted. A machine-readable version of the numeric code 126 may also be located on the play area 120. The machine-readable version of the numeric code 126 may be a bar code, e.g., a stacked linear bar code or two-dimensional bar code. A standard 2 of 5 or other standard bar code may be employed. It will be appreciated that other forms of machine-readable information may be included on the ticket 100, in place of the bar codes, e.g., magnetic strips or smart card capability. It will also be appreciated that the machine readable code 126 may also include other information, e.g., a checking code that may provide sufficient information to identify whether the ticket is a winner without providing sufficient information to authenticate the ticket. Such a check code may be used at a checking station that may be provided to allow customers to test whether they have winning tickets. Other information may also be provided, e.g., the identifier of the pack the ticket comes from.

The play area 120 also includes a player key 127 intended for use with a customer key area, which is explained below.

The customer key area 130 includes information, combinable information in the play area 120, to determine the win or non-win status of the lottery ticket 100. That is, the play area 120 and the customer key area 130 include a first player key 127 and a second player key 137, respectfully, to indicate by comparison whether the lottery ticket 100 is a winner or non-winner. In particular, if the first player key 127 matches the second player key 137 then the lottery ticket 100 is a winning ticket. Otherwise, if the first player key 127 does not match the second player key 137 then the lottery ticket 100 is not a winning ticket (i.e., a losing ticket). In this regard, the win or non-win status of the lottery ticket 100 may be determined and/or confirmed without interpretation of the game information 122 or the instructions/rules 112 of the game, and without the use of any on-line equipment, such as, for example, a retailer terminal or express point. Instead, the purchaser and/or player may determine the win or non-win status simply by visually examining and comparing the first and second player keys, which may take the form of any printable symbol or character, including, for example, a graphic symbol, an alpha-numeric character, or any other suitable visual indication.

Figure 1B:
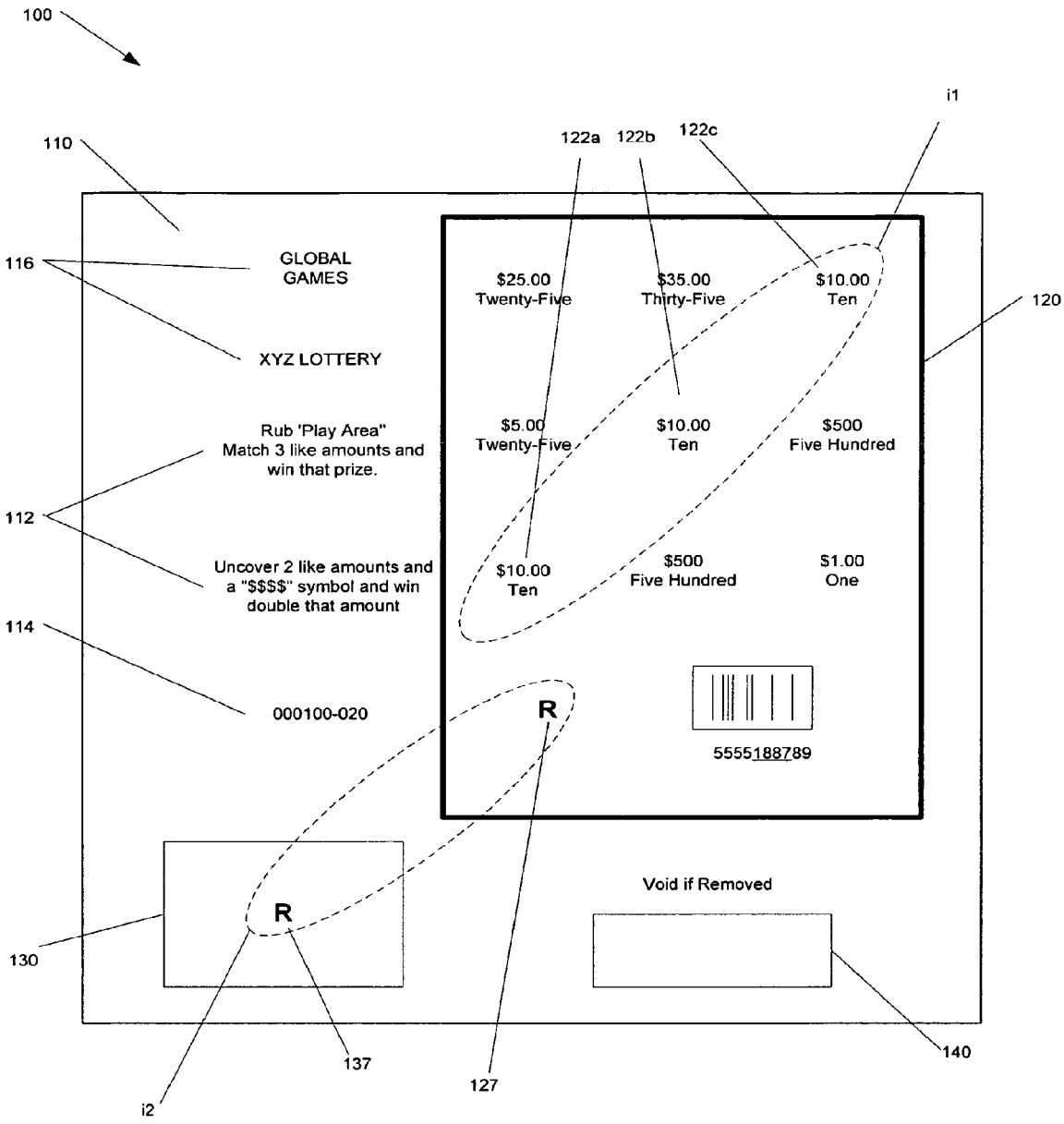
FIG. 1B illustrates an example lottery ticket of FIG. 1A, with annotations demonstrating how the ticket is determined to be a winning ticket.

FIG. 1B demonstrates how the win or non-win status of the exemplary lottery ticket 100 of FIG. 1A may be determined. In this instance, the exemplary lottery ticket 100 is a winning ticket as indicated by two indicia: a first indicia i1 and a second indicia i2. The first indicia i1 is located entirely within the game play area 120 and includes the sequence of game information 122*a*, 122*b*, and 122*c*. First indicia i1 may be determined, for example, by visually examining the game information 122 within the game play area 120 and by interpreting the rules of the game as communicated by the instructions 112. Alternatively, or as a confirmation, the win status of the lottery ticket 100 is also represented by a second indicia i2, which, for example, is partially located in the game play area 120 and partially located outside the game play area 120. The second indicia i2 includes the first player key 127 located within the game play area 120 and the second player key 137 located within the customer key area 130. The second indicia i2 may be determined, for example, by comparing the first player key 127 with the second player key 137 for a match between the two keys, which in this instance is represented by two matching "R" characters.

Figure 1C:
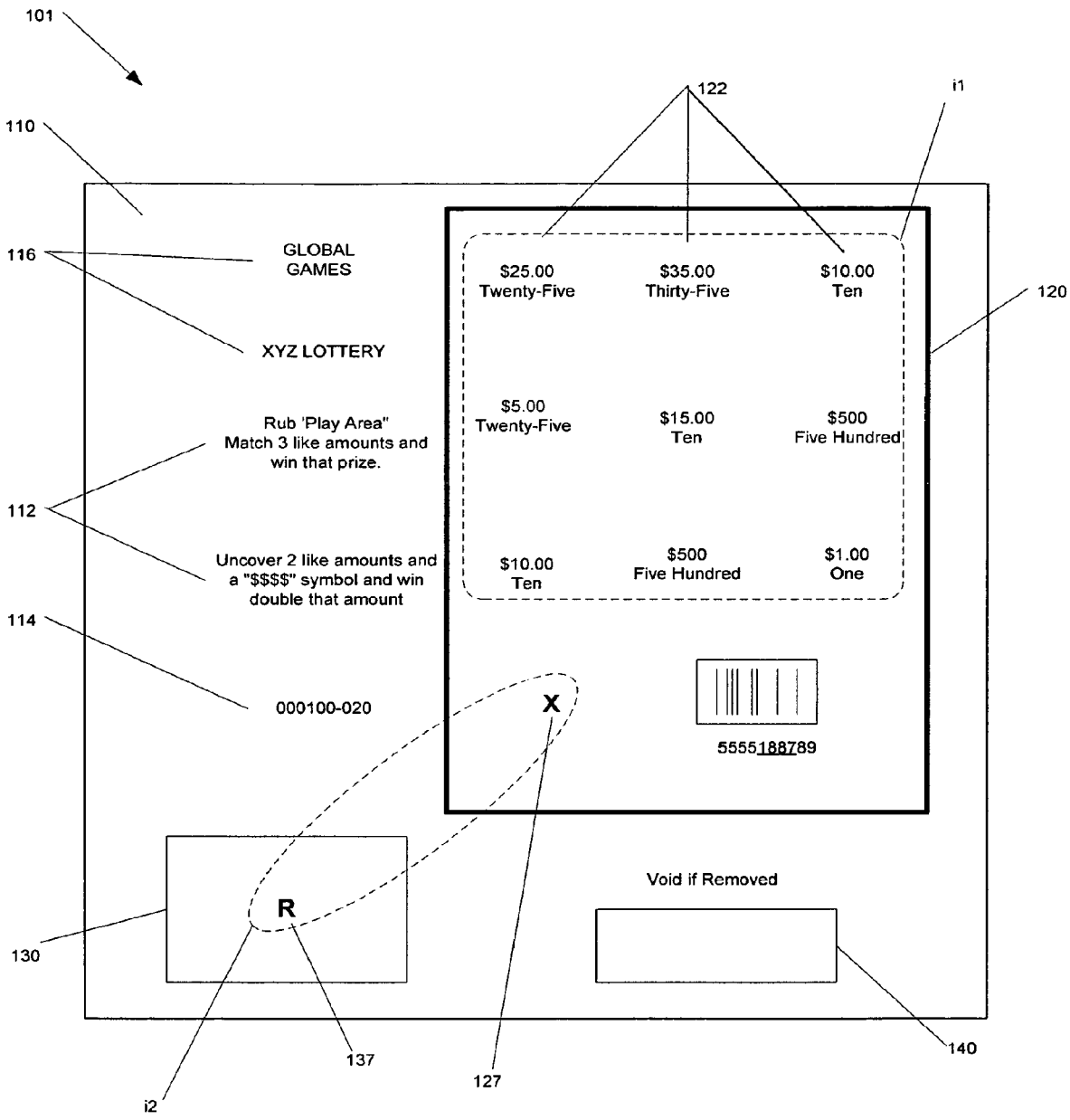
FIG. 1C illustrates an example lottery ticket, with annotations demonstrating how the ticket is determined to be a non-winning ticket.

FIG. 1C demonstrates how the win or non-win status of an exemplary lottery ticket 101 (similar but not identical to the exemplary lottery ticket 100 of FIG. 1A/B) may be determined. In this instance, however, the exemplary lottery ticket 101 is a non-winning ticket as indicated by two indicia: a first indicia i1 and a second indicia i2. The first indicia i1 is located entirely within the game play area 120 and includes all of the game information 122, which in this instance provides no winning combination. First indicia it may be determined, for example, by visually examining the game information 122 within the game play area 120 and by interpreting the rules of the game as communicated by the instructions 112. Alternatively, or as a confirmation, the non-win status of the lottery ticket 101 is also represented by a second indicia i2, which, for example, is partially located in the game play area 120 and partially located outside the game play area 120. The second indicia i2 includes the first player key 127 located within the game play area 120 and the second player key 137 located within the customer key area 130. The second indicia i2 may be determined, for example, by comparing the first player key 127 with the second player key 137, which in this instance is represented by the two non-matching characters "X" and "R".

The use of visual player keys may provide a simple method to confirm the win or non-win status of a lottery ticket, where, for example, the win/lose status of the ticket is difficult to determine, or where the player desires reassurance of his determination of outcome of the game. As such, the player need not visit a lottery location to check the win or non-win status of his ticket(s). In this regard, the player keys may eliminate or at least reduce the need for customers to return non-winning tickets to retailers simply for the purpose of determining the status of the ticket. The player keys may also eliminate or at least reduce the number of winning tickets that are discarded.

The use of the player keys allows players to continue to play as they currently do. Since the first player key by itself does not reveal the status of the ticket, the player may optionally examine the second player key at a time of his choosing, for example, after examining the game information in the game play area so that an enjoyment of the game is not interfered with. The player may also choose not to examine the second player key at all.

It will be appreciated that the play area and customer key areas may be re-arranged and/or combined. For example, the customer key area may partially or fully inclusive within the play area, or may be appear on the reverse side of the lottery ticket.

Figure 2:
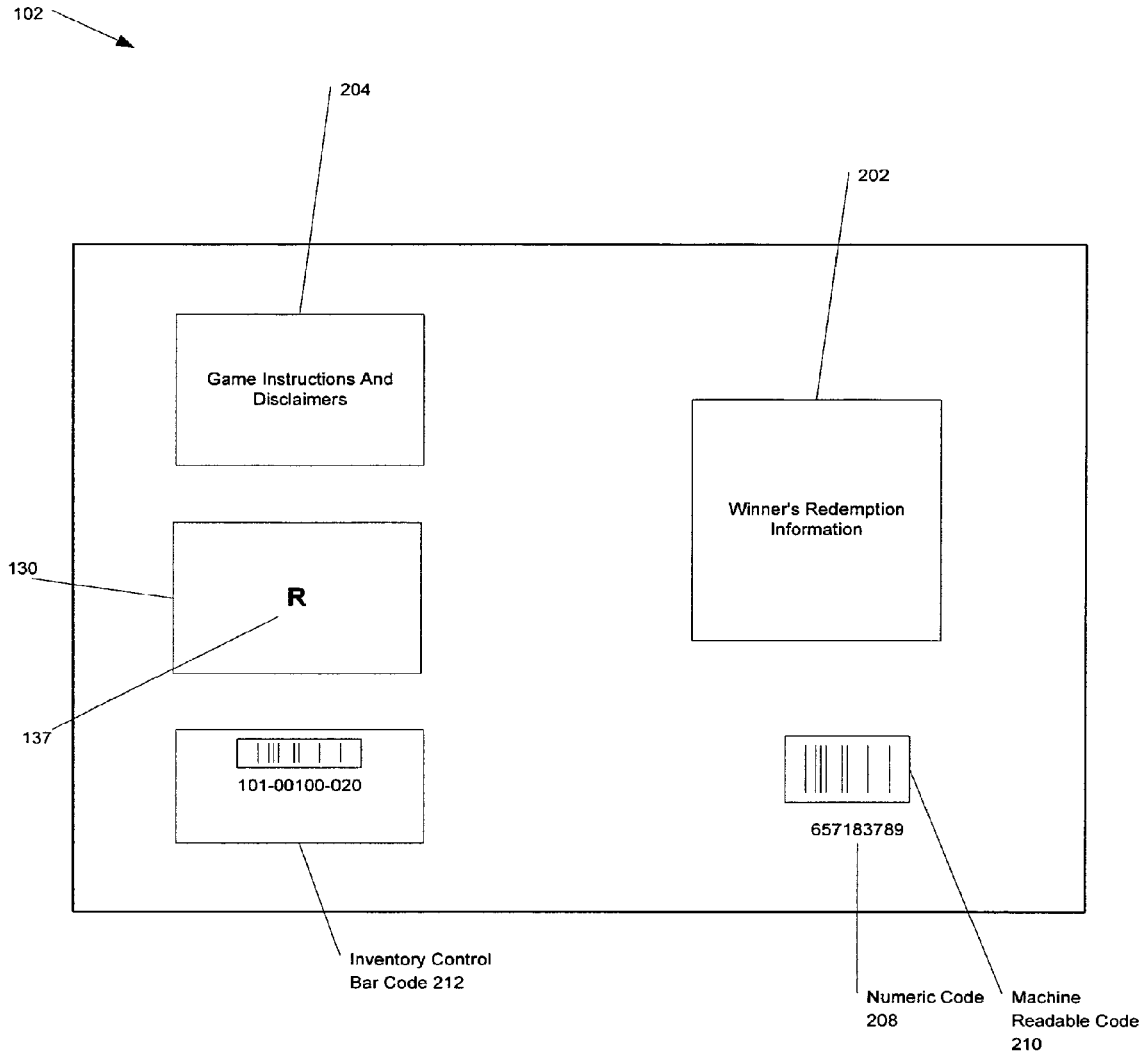
FIG. 2 illustrates the reverse side of an example lottery ticket, according to an example embodiment of the present invention.

FIG. 2 illustrates the reverse side of an example lottery ticket 102, according to an example embodiment of the present invention. The reverse side of the example lottery ticket 102 includes the customer key area 130 with the second player key 137 contained therein. Arranging the customer key area 130 on the reverse side of ticket 102 rather than the front may save space on the front of the ticket 102 and/or reduce potential confusion with the game play area 120.

The reverse side of the example lottery ticket 102 may also include a form 202 for the collection of redemption information. This redemption information may include the signature of the person redeeming the ticket as well as their name, address, telephone number, and age. Depending on the jurisdiction, collection of this information may be required by regulators or may be useful for other purposes, e.g., constructing a direct marketing database. The reverse side of the example lottery ticket 100 may also include game instructions and disclaimers 204, e.g., required legal notices, information about where and how to redeem the ticket, a ticket expiration date, etc.

The reverse side of the example lottery ticket 102 may also include a numeric code 208 and a machine-readable version of the numeric code 210. The numeric code 208 and machine-readable numeric code 210 may include the same information. The numeric code may include authentication information that is required for the authentication of a winning ticket, or for the authentication of winning tickets of greater than a certain amount. More digits may be provided for greater security. Information in the numeric code 208 may also be used to activate the ticket before it is sold. Requiring activation of tickets before sale may make fraud and/or ticket theft more difficult, although it does increase the amount of resources required to sell tickets. The numeric code 208 may also contain other information, e.g., an identification of the lottery selling the game, an identification of the particular game, etc.

The reverse side of the example lottery ticket 102 may also include an inventory control number and/or bar code 212. The information contained in the inventory control number may be used by a retailer to track ticket sales and purchases, but not for ticket authentication. The format for the inventory control bar code may match other standard inventory control codes used by retailers. For example the inventory control number may be a standard UPC code.

Figure 3:
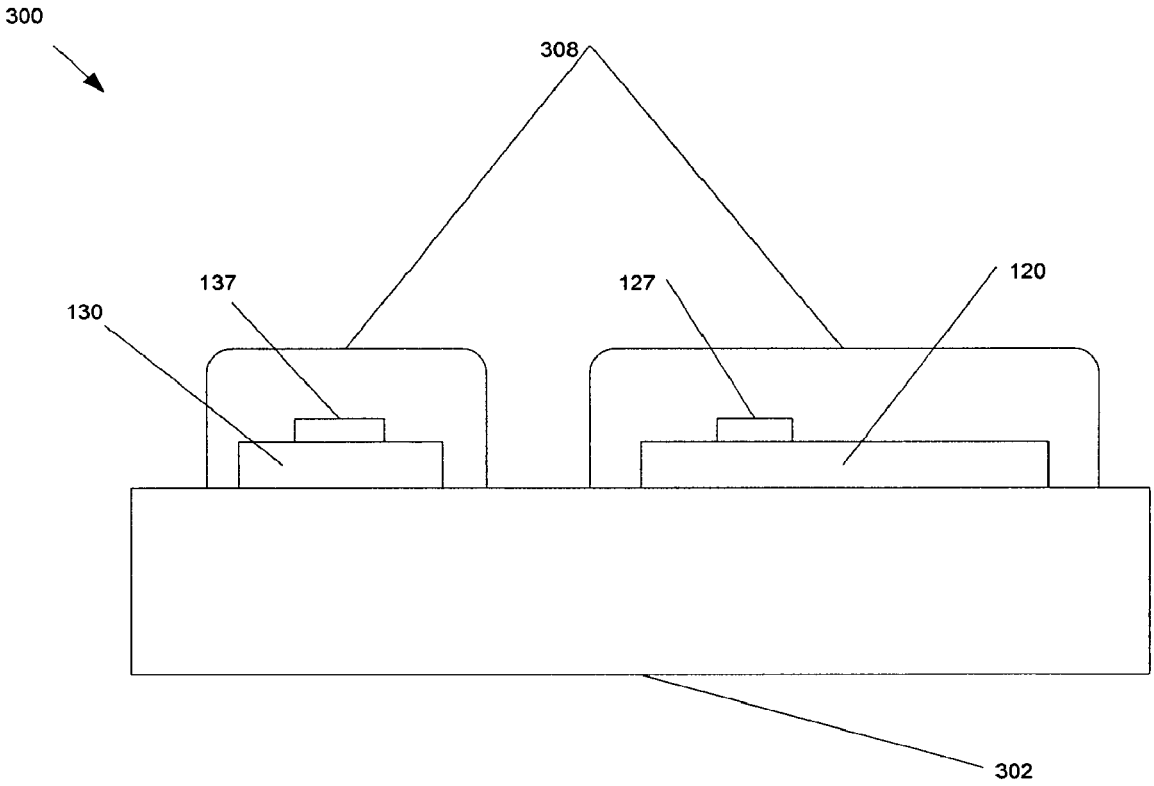
FIG. 3 illustrates an example cross-sectional view of an example lottery ticket, according to an example embodiment of the present invention.

FIG. 3 illustrates an example cross-sectional view of an example lottery ticket 300, according to an example embodiment of the present invention. The example lottery ticket 300 may include a substrate 302, the game play area 127, the customer key area 130, the first player key 127, the second player key 137, and a removable opaque layer 308. The game play area 120 and the customer key area 130 are located on the substrate 301. The first player key 127 is located on the game play area 120 and the second player key 137 is located on the customer key area. Other information, discussed above, may also be located on the game play area 120 or on the substrate 302, including, for example a "void-if-removed" area. The removable opaque layer 308 may cover the game play area 120 and the customer key area 130, including any information located on the game play area 120, such as the first player key 127, and any information located on the customer key area 130, such as the second player key 137. Printed tickets with removable scratch-off layers may be available from many sources, e.g., Pollard Banknote Ltd. of Winnipeg, Canada, Scientific Games Corporation of New York, N.Y., Oberthur Gaming Technologies of Montreal, Canada and Creative Games International, Inc. of Plant City, Fla.

It will be appreciated that the various items located on the card may be re-arranged. For example, the information located in the game play area 120 under the opaque layer 308, including the first player key 127, may be intentionally moved to random locations under the concealing layer in order to prevent "pin-pricking", a form of fraud where pin-pricks are used to determine what is located under the concealing layer.

It will be appreciated that all the information displayed on the card, and in particular the authentication codes, need not be printed, but may be included on the card using other approaches, e.g., using a machine-readable magnetic stripe or smart code.

Figure 4:
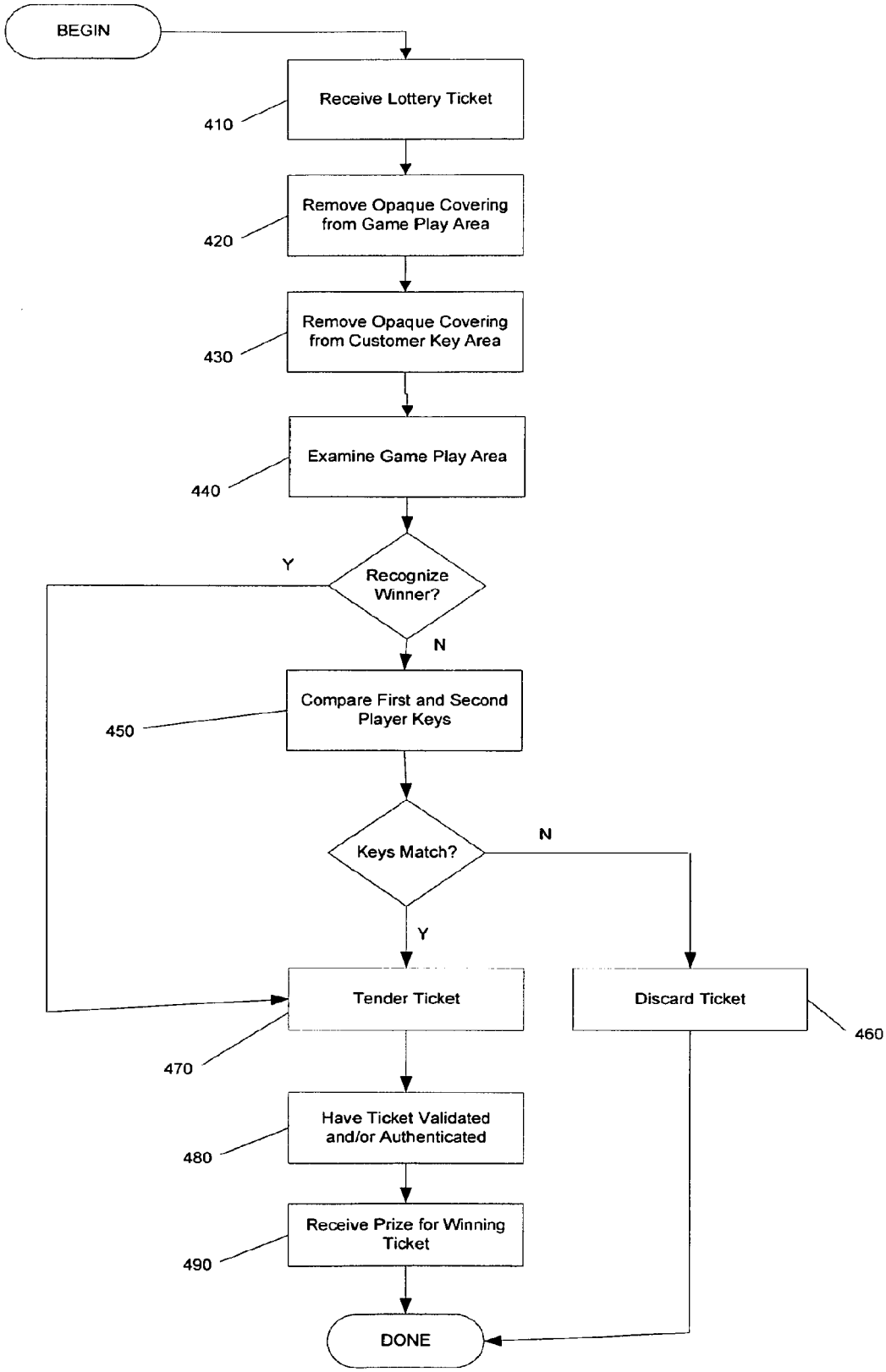
FIG. 4 illustrates an example procedure for playing a game of chance, according to an example embodiment of the present invention.

FIG. 4 illustrates an example method for playing a game of chance, according an example embodiment of the present invention. In 410, a ticket may be received for a game of chance. The ticket may be received in a variety of ways, e.g., by requesting a ticket from a cashier or establishment operator or by purchasing a ticket from a vending machine that generates such tickets. The ticket may include information contained in the example tickets explained previously. For example, the ticket may include game information, a first player key, and a second player key concealed by a removable opaque covering. In particular, the game information and the first player key may be located within the game play area of the ticket, and the second player key may be located in the customer key area of the ticket.

In 420 the opaque covering concealing the game play area is removed to reveal the game information and the first player key. The game information includes indicia to visually indicate whether the ticket is a winning ticket, such as, for example, a required sequence and/or arrangement of matching prize winning amounts. The first player key may be, for example, an alpha-numeric character or graphic symbol.

In 430, the opaque covering concealing the customer key area is removed to reveal the second player key, which may be, for example, an alpha-numeric character or graphic symbol.

In 440, the game player area is examined to determine the winning status of the ticket. If the player recognizes a winning ticket then ticket may be tendered for a prize. Otherwise, if the player does not recognize winning ticket or if the player is unsure the customer key area may be examined for a matching player key.

In 450, the first and the second player keys are compared. If the first player key matches the second player key then the ticket is a winning ticket. Otherwise, if the first player key does not match the second player key then the ticket is a non-winning or losing ticket and may be discarded 460. A winning ticket may be redeemable for a prize.

In 470, the ticket may be tendered, e.g., by presenting it to a cashier or placing it in a vending machine. The gaming procedure may require tickets to be redeemed at the same establishment where they were sold, or may allow the tickets to be redeemed at a future time and at various locations.

In 480, the ticket may be authenticated to determine whether the ticket is actually a valid winning ticket, e.g., if the ticket is a winning ticket and has not previously been redeemed. The authentication may be performed by use of an authentication code that uniquely identifies the ticket. Conventional schemes for authenticating tickets may be employed, e.g., the authentication code may be used as part of a public key encryption system. The authentication code may be used to query a log or database of information identifying the previously sold tickets as winning tickets or losing tickets. In the event that a ticket is identified as a winning ticket, the log or database may also indicate the prize. Alternatively, the prize information may be encoded in the authentication number, e.g., by using a public encryption systems. Once redeemed, information regarding the redemption may be recorded so that any subsequent attempts to redeem the ticket may be prevented.

In 490, if the ticket is a valid winning ticket, a prize may be exchanged for the winning ticket. The prize may be anything of value including additional tickets. The ticket may be branded or visually marked to indicate on the face of the ticket that it has been redeemed for a prize. In this regard, it may be apparent to other that the ticket has been redeemed without the need for further authentication.

Figure 5:
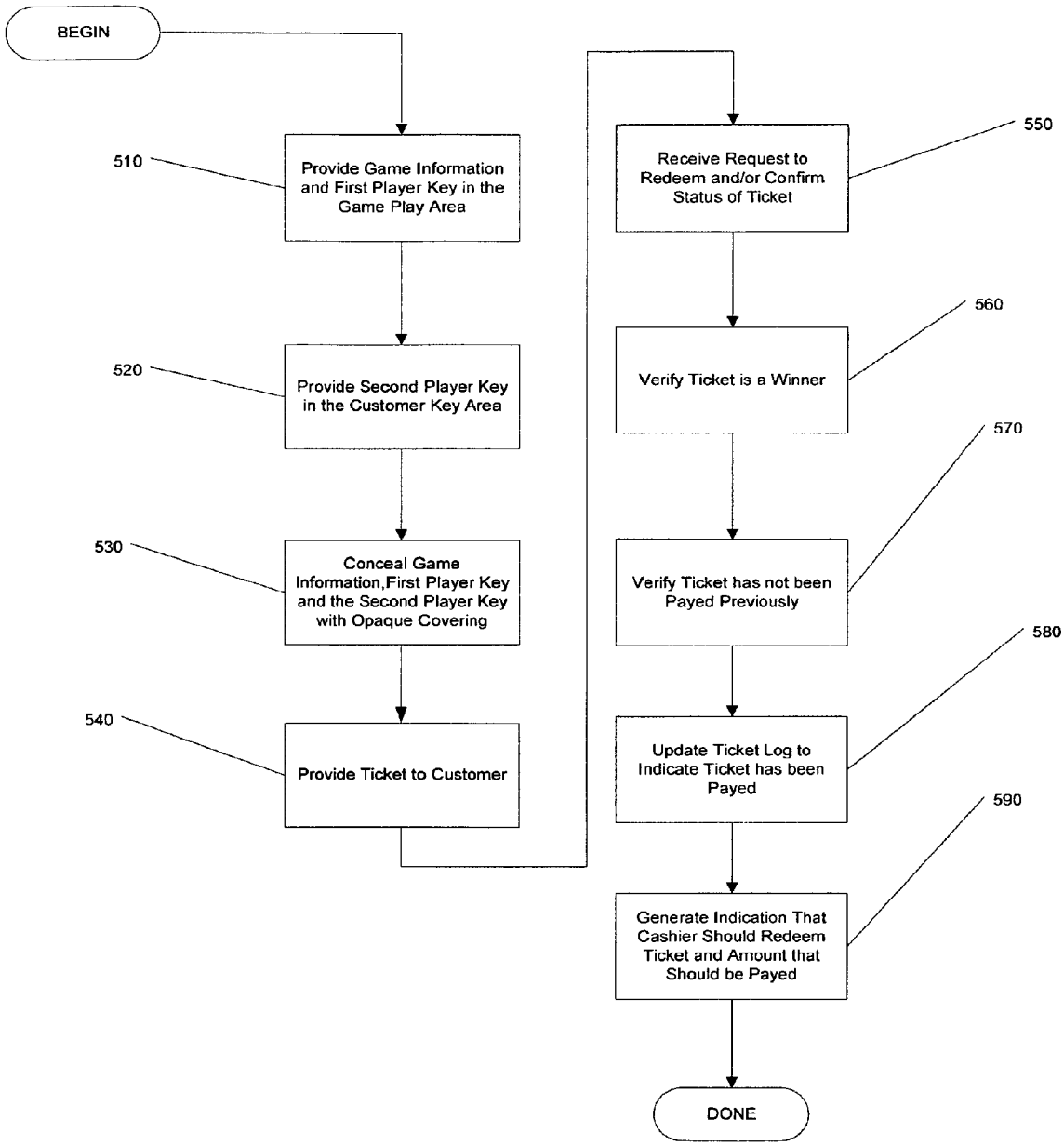
FIG. 5 illustrates an example procedure for facilitating the play of a game of chance, according to an alternative example embodiment of the present invention.

FIG. 5 illustrates an example procedure for facilitating the play of a game of chance, according to an example embodiment of the present invention. In 510, a game ticket is provided with game information and a first player key in the game play area of the ticket. The game information includes indicia visually indicating whether the game ticket is a winning ticket.

In 520, the game ticket is provided with a second player key in the customer key area of the ticket. The second player key, along with the first player key, provide an alternative way to determine whether the ticket is a winning ticket. In particular, if the first player key matches the second player key then the ticket is winning ticket. Otherwise, the ticket is a non-winning ticket. In this regard, whether the game ticket is a winning ticket is determinable upon visual examination of the first and second player or upon visual examination of the game information within the game play area.

In 530, the first player key, the second player key, and the game information are concealed by the application of a removable opaque covering. For example, this may involve applying the removable opaque covering to the game play area and the customer key area.

In 540, the ticket is provided to a customer. The ticket may be provided by a cashier or attendant, or with an automated point of sale system. It will be appreciated that a customer may be anyone who receives a ticket.

In 550, a request to redeem and/or confirm the winning status of a ticket is received. In particular, the ticket may be tendered, e.g., by turning it in to a cashier or attendant, or with an automated point of sale system by inserting it into an automatic reader. It will be appreciated that the occurrence of customers attempting to redeem or request confirmation of non-winning tickets should decrease since the customer may visually confirm the winning or non-winning status of his ticket by examining the player keys.

In 560, whether the ticket is a winning ticket may be verified. This information may be determined by looking up the authentication code or other information uniquely identifying the ticket in a log that includes information identifying the previously sold tickets as winning tickets or losing tickets. In the event that a ticket is identified as a winning ticket the prize may also be in the log. Alternatively, the prize information may be encoded in the authentication number, e.g., by using a public key encryption system.

In 570, whether the ticket has been previously tendered may be determined, including, for example, by examining a redeemed field in a ticket log to verify that the tendered ticket has not been previously redeemed. In the event that the ticket log indicates that a ticket has been previously redeemed a message may be sent to the operator indicating that the ticket has been redeemed.

In 580, a ticket log may be updated to reflect that the tendered ticket has been tendered for redemption so that the same ticket may be prevented from further redemption attempts.

In 590, an indication may be provided indicating that the ticket is redeemable, e.g., by displaying a prompt on a redemption system display, along with the amount to be paid. Alternatively, in an automated system, the ticket validation/authentication procedure may initiate a ticket payment procedure automatically, once the ticket has been validated.

It will be appreciated that other actions may be included in the example method for authentication and payment. For example, electronic payment may require different procedures. Extra security measures may be provided for large prizes, or old tickets, or tickets that were sold at an other establishments.

It will be appreciated that alternative procedures may be used for playing and/or providing the game of chance, including, for example, various methods for the sale and activation of tickets.

It will be appreciated that the example and alternative example procedures illustrated above may be provided as a series of instructions adapted to be executed by a processor. These instruction may be provided on an article of manufacture, e.g., a disk, a tape, a memory, a CD-ROM, etc.

Figure 6:
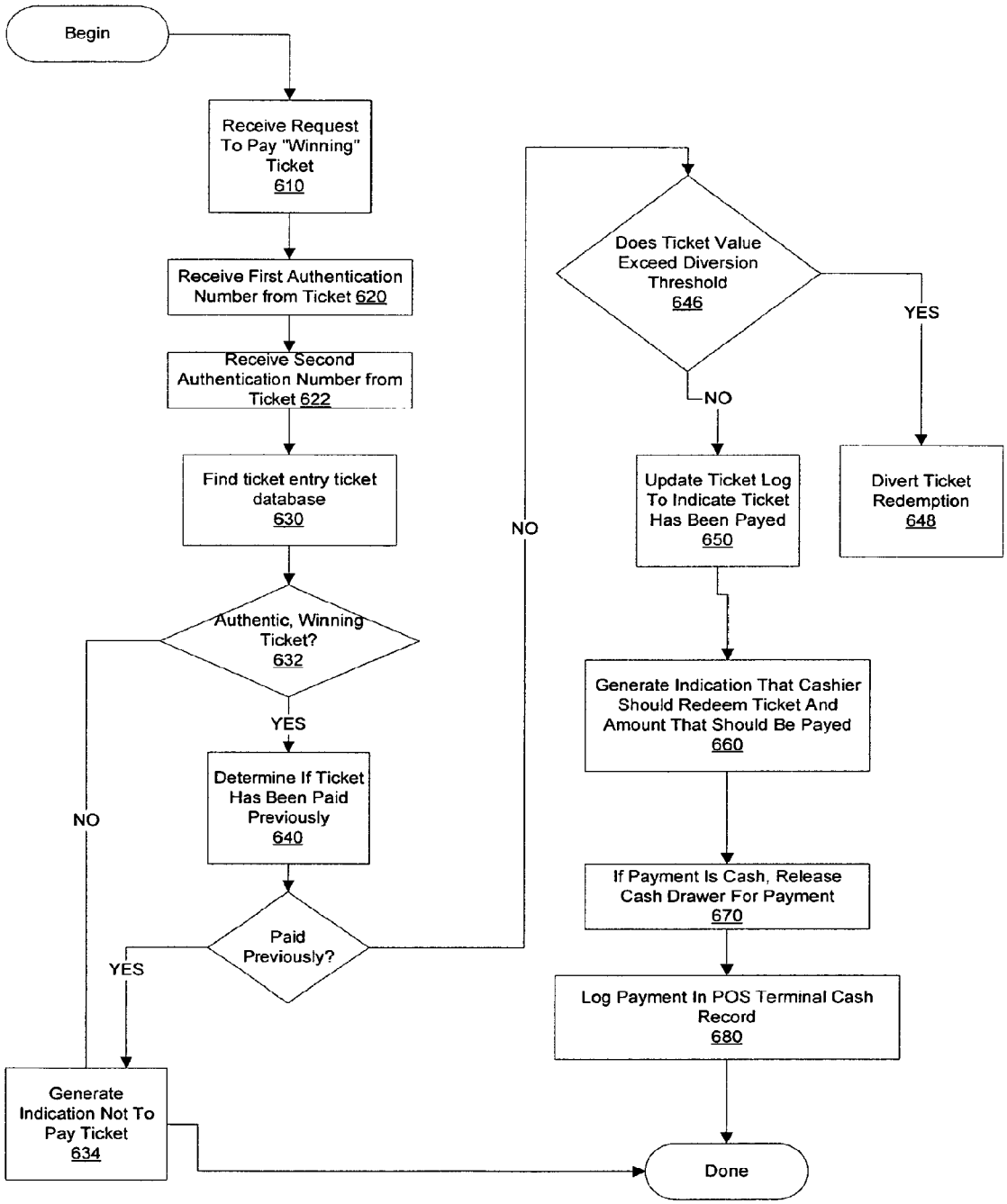
FIG. 6 illustrates an example redemption procedure for instant-win lottery tickets, according to an example embodiment of the present invention.

FIG. 6 illustrates an example validation procedure for instant-win lottery tickets, according to an example embodiment of the present invention. In 610, a request to pay a "winning" ticket may be received. For example, a customer may tender an instant-win ticket to a cashier at a lottery point of sale terminal, or the ticket may be inserted into an automated vending machine that is configured to redeem tickets.

In 620, a piece of authentication information from the ticket may be received. A machine readable code, not originally found under the removable coating on a scratch-off instant-win lottery game may be scanned, e.g., using a bar code scanner. The scanning may be performed by a ticket agent, e.g., with a scanning wand, or by an automated point of sale terminal that includes a scanning device. The code read from the ticket may be the first piece of authentication information, or it may contain the first authentication information, e.g., as a subset of the digits or other predetermined function. This may be the same code originally used to activate the ticket, if pre-sale activation is employed. Alternatively, both activation and authentication codes may be separate, either as two separate machine readable codes, or as different parts of a single machine readable codes, e.g., different digit positions in a single code.

In 622, a second piece of authentication information may be received from the tendered ticket. A second machine readable code, originally located under the removable coating on a scratch-off instant-win lottery game may be scanned, e.g., using a bar code scanner. Because the machine readable code located under the removable opaque layer should only be readable after the ticket has been played, the code read from the ticket may be the second piece of authentication information by itself, or it may contain the second piece of authentication information, e.g., as a subset of the digits or other predetermined function.

In 630, information about the tendered ticket may be retrieved. This may be accomplished, in some applications, by processing the information and looking up information contained in the point of sale terminal, e.g., in a prize pool.

Alternatively, 630 may also involve transmitting a predetermined function of the scanned authentication numbers to a central lottery control or database system, e.g., the entirety of both codes, a subset of each code, a sum of the codes, a concatenation of the codes, etc. The central lottery control or database system may then process the authentication codes, e.g., by checking corresponding entries in a ticket database. The central lottery control system may include a database of all tickets in the game, whether they are winners, whether the amount they win, whether the tickets have been activated, etc. The authentication information from the tendered ticket may be used as a key to look up an appropriate entry in the ticket database. It will be appreciated that more than two pieces of authentication information may be employed in alternative implementations of the example authentication procedure.

In 632, whether the ticket is an authentic winning ticket may be determined. For example, a ticket without an entry in the database would not be redeemable. Also the ticket's entry in the database may indicate the ticket is a losing ticket. If the ticket is not an authentic winning ticket the example procedure may continue with 634. Otherwise the example procedure may continue with 640.

In 634, a message may be transmitted to the point of sale terminal that the ticket is not a winning ticket. The point of sale ticket may generate a message to indicate the ticket is not a winning ticket, e.g., by sending a message to a screen visible to the operator or to the customer. It may also be useful to generate instructions for how to determine a winning ticket from the game ticket, because it may be likely that the customer has incorrectly interpreted the ticket and does not understand how to identify a winning ticket.

In 640, information on whether the ticket has been previously redeemed may be looked up in the ticket database. It may also be useful to verify the ticket has been activated, if activation of tickets prior to sale is required in the particular implementation of the example procedure. If the ticket has been previously redeemed an appropriate message may be generated, and the example procedure may continue with 634, sending a message to the point of sale terminal and/or operator not to redeem the ticket. If the ticket has not been previously redeemed the example procedure may continue with 646.

In 646, tickets of greater than a certain value may be diverted. For example tickets redeemable for prizes greater than $500 may be diverted. Tickets may also be diverted for other reasons, e.g., tickets flagged for random audits, or tickets that have been flagged by security procedures as suspicious for other reasons, e.g., tickets from packs which have been identified as lost or stolen. If the redemption is diverted, the example procedure may continue with 648. Otherwise the example procedure may continue with 650.

In 648, ticket redemption may be diverted. For example, a message may be sent to the point of sale terminal that indicates the customer should bring the ticket to a lottery service center for validation and redemption. Such procedures are conventionally used in many lottery and other gaming applications. Large tickets can then be authenticated in person. In addition to improving security, diverting large tickets also has the advantage of reducing the likelihood that a retailer will be unable to redeem a large ticket because they do not have sufficient cash on hand.

In 650, the ticket database may be updated to indicate the ticket has been redeemed. Conventional locking procedures may be used to insure atomic redemption transactions, prevent problems with lost connections or computer crashes. Such procedures protect customers from being unable to redeem winning tickets after such failures have occurred, and may also be included to prevent fraudulent redemption schemes.

In 660, an indication that the ticket should be redeemed may be generated, e.g., by the central lottery computer sending a message to the lottery point of sale terminal. This signal may cause an automated point of sale terminal to dispense cash for the winning ticket, or may cause a message to be displayed in a conventional lottery point of sale terminal that indicates the attendant should pay the winning ticket.

In 670 and 680, conventional cash management procedures may be followed, e.g., by opening a cash drawer and logging the payment made. Alternatively, correct amounts may automatically be dispensed and logged, e.g., from a automated vending machine type application.

It will be appreciated that other operations may be included in the example procedure, and that the operations of the example procedure may be re-ordered. For example, additional promotional activities may be incorporated into the procedure, such as offering to allow the customer to purchase new tickets or receive store credit instead of receiving cash for a winning ticket. Multi-level security procedures may be employed, with an initial screening at the terminal for small amounts, and a central database screening used only for larger amounts. Diverted tickets, because they are of great interest to anyone interested in fraud because of the high value, may be excluded from the database. Rather, a diverted ticket may simply have a diversion instruction on it, and not be redeemable electronically, and the identities of the diverted tickets may be stored in a special high-security list not normally accessible to remote terminals. It will be appreciated that many other variations to the example authentication procedure may also be employed.

It will be appreciated that the example validation procedure illustrated above may be provided as a series of instructions adapted to be executed by a processor. These instruction may be provided on an article of manufacture, e.g., a disk, a tape, a memory, a CD-ROM, etc.

Figure 7:
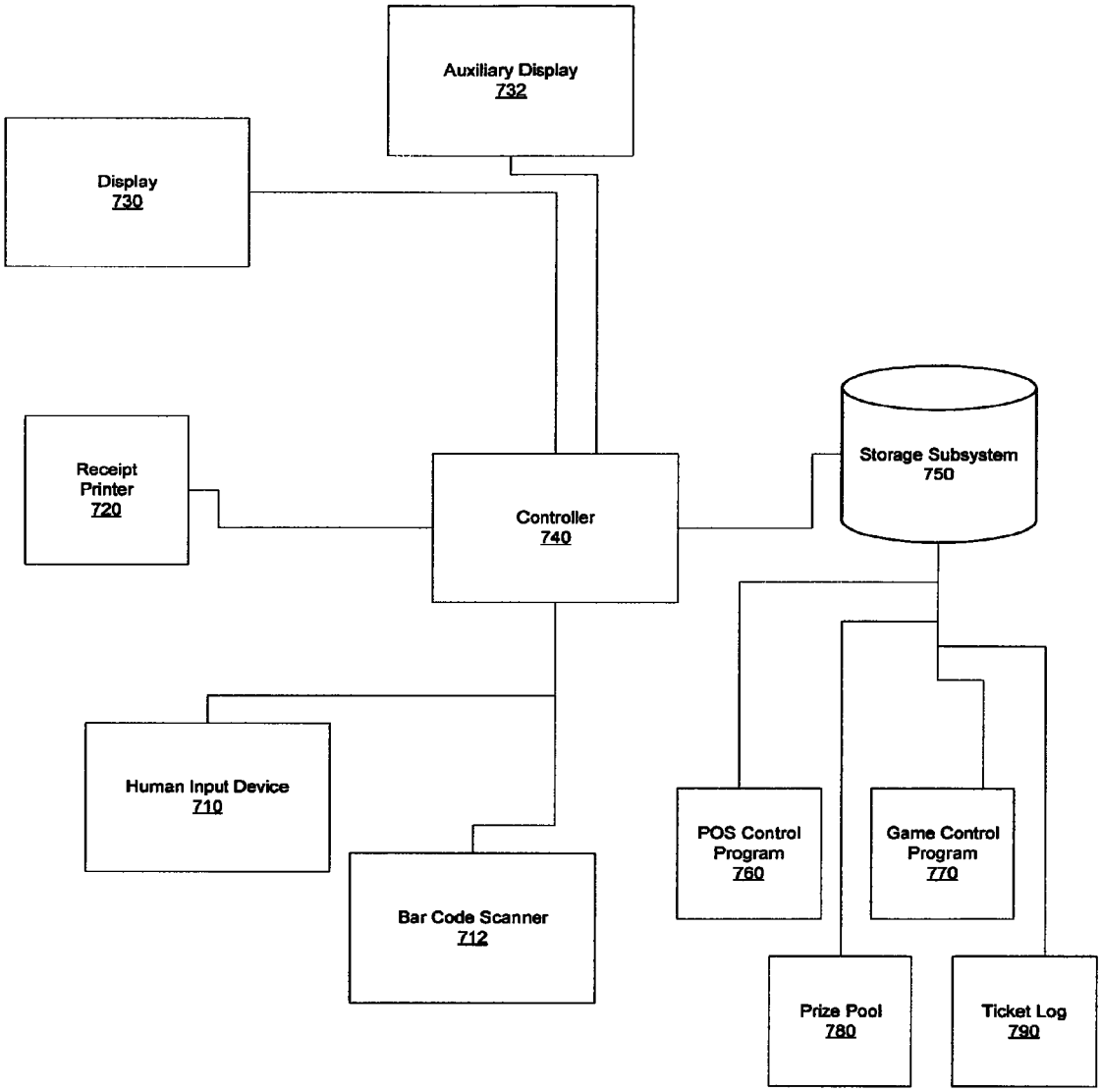
FIG. 7 illustrates a block diagram of an example point of sale terminal, according to an example embodiment of the present invention.
Figure 8:
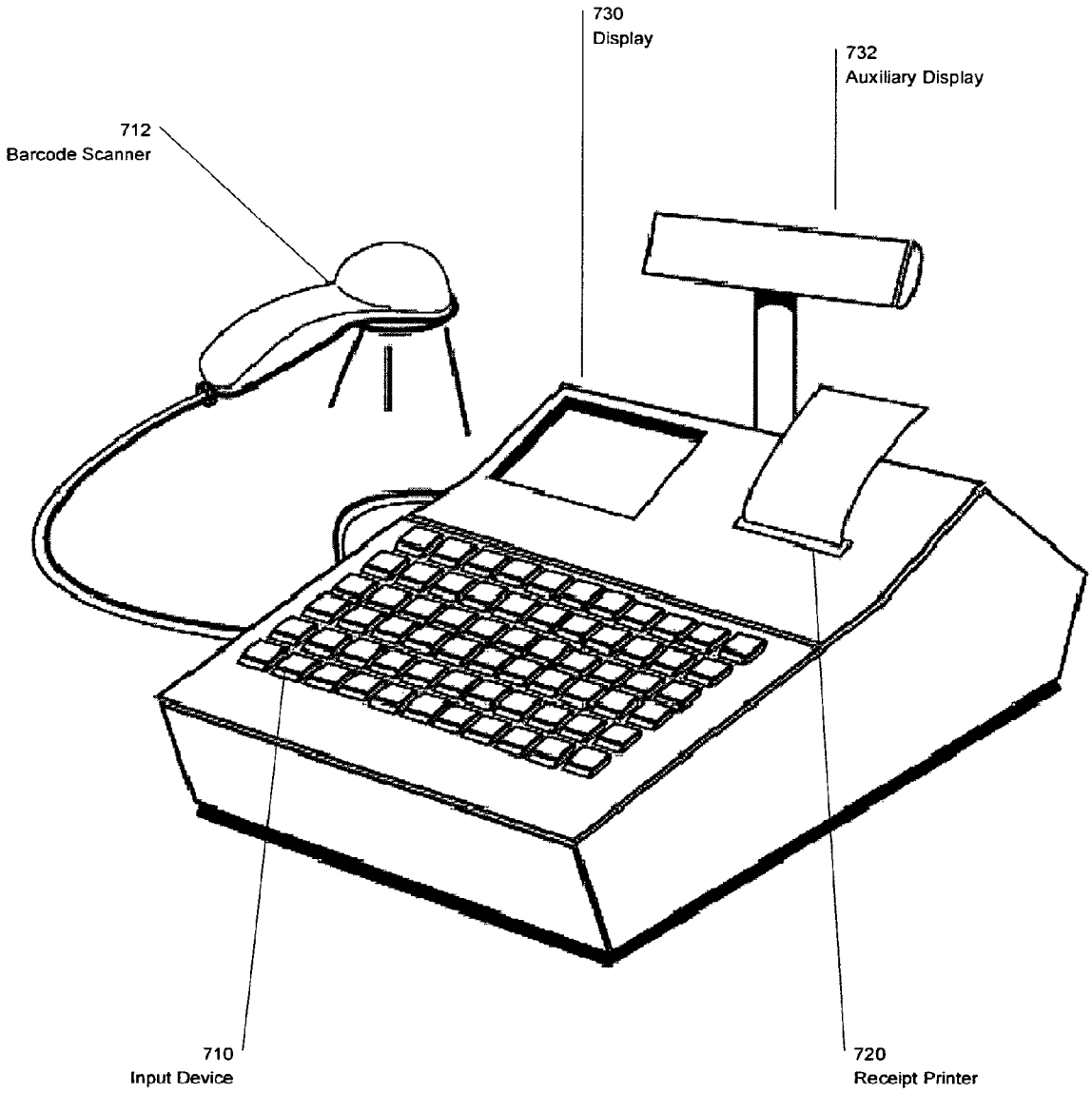
FIG. 8 illustrates an external physical view of the example point of sale terminal, according to an example embodiment of the present invention.

FIG. 7 illustrates a block diagram of an example point of sale terminal, according to an example embodiment of the present invention. FIG. 8 illustrates an external physical view of the example point of sale terminal, according to an example embodiment of the present invention. The example point of sale terminal may be configured for use with instant-win lottery tickets or other games. The example point of sale terminal may be a specialized "lottery-only" terminal or may also be configured to function as a conventional point of sale terminal, e.g., as a cash register for other merchandise.

The example point of sale terminal may include an input device 710. The input device may be configured to facilitate human input to the point of sale terminal. The input device may be a keyboard, keypad, touch screen, or other input device. Voice input may also be included, provided proper security measures are available. It will appreciated that different formats of input devices may be used in attended and automated point of sale terminals. The example point of sale terminal may include a barcode scanner 712. The barcode scanner may be replaced by any other suitable machine input device capable of inputting machine-readable information from a game ticket, e.g., a magnetic stripe scanner, a smart card reader, etc. The bar code scanner or other input device may be configured to read a machine-readable code, e.g., a bar code, from a first area on the instant-win lottery ticket not previously covered with a removable opaque coating, e.g., the code on the back of the ticket previously illustrated. This machine readable code may be read when a ticket is sold and used to activate the ticket. The input device may also be configured to read this code when the ticket is tendered for redemption. The input device may be further configured to read a second machine-readable code from the game play area on an instant-win lottery ticket when the lottery ticket is tendered for redemption. This game play area is the area that was previously covered with the removable opaque coating, such as a scratch-off layer. Both the machine readable codes may include authentication information, such as a numerical or symbolic code. The input device may be configured to transmit this information to the controller of the point of sale terminal, or alternatively, to transmit it directly to a central server or lottery database computer. It will be appreciated that the input device may operate automatically, e.g., in an unattended vending machine style terminal, or may be used by an attendant at a conventional lottery point of sale terminal, e.g., by swiping the ticket with a bar code scanning wand. Alternatively, an attended point of sale terminal may allow the ticket to be inserted into the machine and scanned automatically.

The example point of sale terminal may include a receipt printer 720. The receipt printer may be configured to print receipts for game ticket purchases and redemptions. In some applications, the receipt printer may be configured to print the game tickets themselves.

The example point of sale terminal may include a display 730. In an attended point of sale terminal this display may be configured to display information to the attendant. The example point of sale terminal may include an auxiliary display 732. In an attended point of sale terminal this may be configured to display information to a customer. In an unattended terminal a single display may replace the display and auxiliary display. In either application, the display may be any conventional display, e.g., LCD, CRT, or other display technology.

The example point of sale terminal may include a controller 740. The controller may be a microprocessor, single board computer, personal computer, or other type of controller.

The controller may be connected to the other components of the point of sale terminal via a bus, a network, or other form of connection that facilitates communication between the controller and other components of the point of sale terminal. The controller may be configured to direct the operations of the input and output devices, receiving information from the input devices and sending information for output to the output devices. The controller may be configured to have the output device prompt an attendant to scan one or more codes from a ticket, either to activate the ticket before sale, or to authenticate the ticket when tendered for redemption.

When a ticket is tendered for redemption, the controller may be configured to receive both authentication information read from the barcode scanner or other input device. These pieces of authentication information may be obtained from at least two separate machine readable codes on the ticket, one previously under the scratch-off layer, and one not previously under the scratch off layer. The authentication information may be the machine readable codes, may be part of the machine readable codes, or may be determined using some predefined function of the machine readable codes, e.g., a concatenation of two codes. The controller may be further configured to authenticate the game ticket using at least both the first piece of authentication information and the second piece of authentication information. For example, this may be accomplished by using the authentication information, either separately or in combination as an index to look up the tendered ticket in a ticket database. For example, the two pieces of information may be concatenated or added together to form a single index for looking up the ticket in a ticket database or table. Alternatively, two separate authentication operations may be performed, one with each code, with the ticket ultimately being found valid only if both operations are successful. A third alternative is to perform a single validation operation, but to use the two pieces of information as successive indices into a two-level hash system or other table used for ticket validation.

If the controller finds that the ticket is a valid, e.g., when both pieces of authentication information are present and valid, and that the winning ticket that has not been previously redeemed, the controller may be further configured to signal the output device to output a message indicating that the game ticket should be redeemed. If the controller finds the ticket is invalid, a loser, or has been previously redeemed, the controller may be further configured to signal the output device to output a message indicating that the game ticket should not be redeemed.

The example point of sale terminal may include a storage subsystem 750. The storage subsystem may include RAM memory, flash memory, disk, CD-ROMS, or other forms of storage. The storage subsystem may be separate from or contained within the controller or another component of the point of sale terminal. The storage subsystem may be provided as a single unit, or as separate units for separate types of information needing storage.

The example point of sale terminal may include a POS control program 760 which may be stored in the storage subsystem. The POS control program may be configured to control conventional point of sale operations of the point of sale terminal, e.g., if the terminal is used for regular cash register sales operations or for the sales of other types of game tickets besides those described herein.

The example point of sale terminal may include a game control program 770 which may be stored in the storage subsystem. The game control program may be used to control game operations at the point of sale terminal, e.g., the sale, activation, authentication, and redemption of instant-win lottery tickets such as those illustrated previously.

The example point of sale terminal may include a prize pool 780 which may be stored in the storage subsystem. The prize pool may include information about the prizes associated with various tickets. This information may alternatively be stored in a central lottery computer or server, as will be described below.

The example point of sale terminal may include a ticket log 790 which may be stored in the storage subsystem. The ticket log may include information on which game tickets have been activated or sold, which have been redeemed, etc. An entry may be included in the ticket log for each ticket, or for each ticket that has been activated. The entries may be indexed by the authentication codes found on a ticket, or by some other approach. It will be appreciated that the ticket log and prize pool may be merged into a single file or database. It will also be appreciated that no particular data structure need be employed for the prize pool or database, provided information on tickets can be accurately and efficiently located. For example, arrays, relational databases, hash tables, or other data structures may all be employed.

It will be appreciated that the example point of sale terminal may be configured to perform operation needed to implement the example ticket sale, activation, authentication, and redemption procedures described previously. It will also be appreciated that some game control program operations may not be performed on the point of sale terminal, but instead may be performed by a server or central lottery database computer. In such case, the game control program or other program in the point of sale terminal may need to control the point of sale terminals interaction with the server or central lottery database computer, e.g., by sending and receiving information from the server or central lottery database computer.

Figure 9:
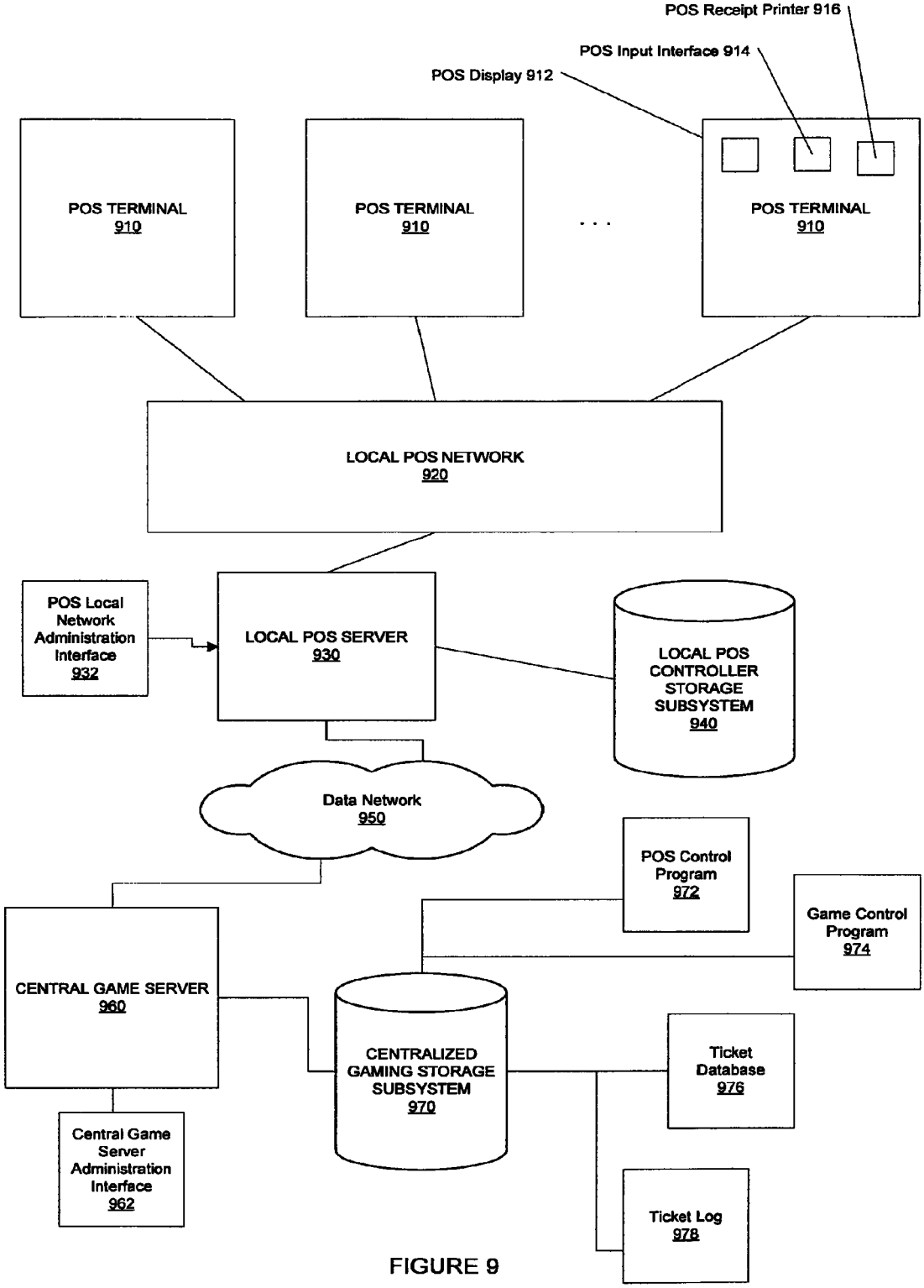
FIG. 9 illustrates an example distributed system for sale and redemption of game tickets, according to an alternative example embodiment of the present invention.

FIG. 9 illustrates an example distributed system for sale and redemption of game tickets, according to an example embodiment of the present invention.

The example distributed system may include one or more Point of Sale (POS) terminals 910. An example POS Terminal may include a display 912, an input interface 914, and a receipt printer 916. These POS terminals may be similar to the POS system described previously in FIGS. 8 and 9, although some of the control functions for game operations may be located outside the POS terminal, e.g., in the central game server or alternatively in a local POS server.

The POS terminals in a location or close to each other may be linked via a local POS network 920, e.g., a LAN such as an Ethernet or token ring. This POS network may but not include facilities for controlling the POS terminals. For example, a local POS server 930 may be connected to the POS terminals 910 via the local POS network 920 and may control normal POS operations, such as cash register operations, as well as providing communications with a central gaming database or server. The local POS server may include a local network administration interface 932, which may be provided as a terminal or other access method to the local POS server. This may be used to control local security, backups, and generally control conventional POS operations. The local POS server may also include a storage subsystem 940 for storing information needed to administer the local POS network and control conventional terminal operations.

The local POS server, and the POS terminals via the local POS server, may be connected to a data network 950. This data network may utilize the telephone network, the interne, or some other form of wide area networking. It will be appreciated that alternative arrangements may be employed, e.g., the local POS server may be omitted and the POS terminals may be connected directly to the network. The local POS server may provide other functions as well, e.g., encrypting and decrypting information before it is sent over the data network 950.

The example distributed system may include a central game server 960 which may be connected to the POS terminals and/or local POS server via the data network. The central game server may be administered through an administration interface 962. The central game server may include or be connected to a centralized gaming storage subsystem 970, which may be used to store information about gaming, such as tickets, game rules, information on sales, redemptions, etc. The centralized gaming storage subsystem may include copies of POS control programs 972 which may be downloaded to control local POS terminals, e.g., when changes in POS terminal operations are desired. The centralized gaming storage subsystem may also include game control programs 974 for controlling the central server's involvement in activation, authentication, and redemption of game tickets. The centralized gaming storage subsystem may also include a ticket database 976 and a ticket log 978. These two structures may be separate, or may be combined as part of a single database or file. The ticket database may include information on tickets and their associated prizes—e.g., which tickets are valid game tickets, which tickets are winners, and what the values of the winning tickets are. The ticket log may include information on whether, when, and where tickets have been activated, and on whether when and where tickets have been tendered for redemption. The central game server may be configured to look up tickets when information about the tickets is received, both to activate the tickets, and when redemption of the tickets is sought. For example, the controller may be configured to perform the operations described in the example ticket activation and authentication procedures described above.

It will be appreciated that the central game server may have include other capabilities, e.g., audit programs, accounting operations, additional security measures, etc. It will also be appreciated that any conventional data structure or storage method may be used for storing ticket information, e.g., relational databases, arrays, files, hash tables, etc.

In an alternative embodiment, the information for all tickets may be stored in the central computer and the information for a particular pack of tickets may be downloaded to the point of sale terminal when the pack of tickets is activated. This alternative approach, while potentially causing a slight reduction in security, may greatly increase the efficiency of ticket validation and redemption, because the point of sale terminal would not need to contact the central computer to validate every redeemed ticket. Other alternative distributions of information and processing may also be employed, e.g., some processing for tickets may be done on a local server, rather than on a point of sale terminal or at the central lottery server.

Figure 10A:
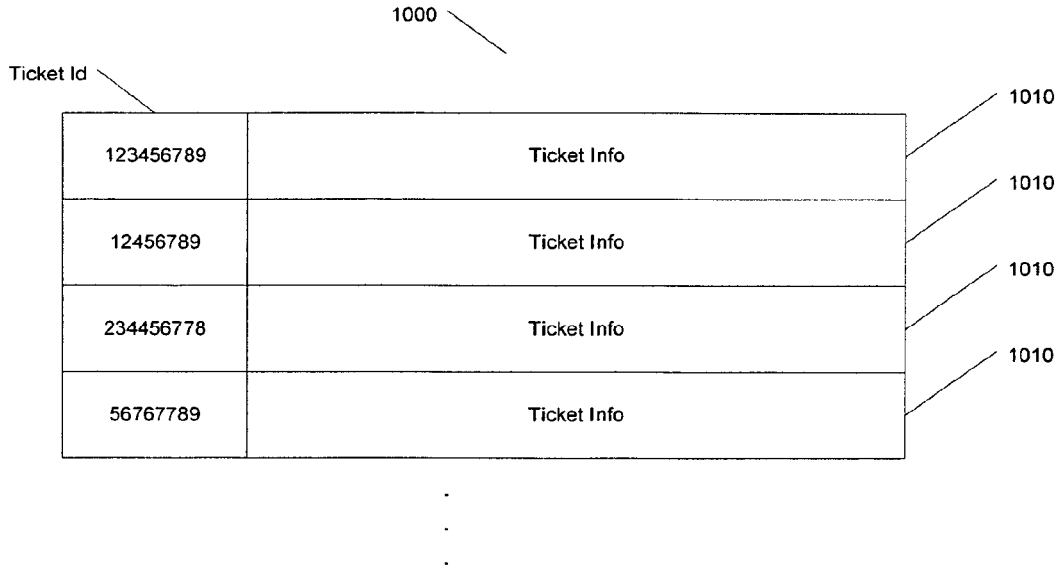
FIG. 10*a* illustrates an example ticket information table, according to an example embodiment of the present invention.

FIG. 10*a* illustrates an example ticket information table, according to an example embodiment of the present invention. The example table 1000 combines a ticket log and ticket prize database in a single data structure. It will be appreciated that the ticket log and ticket prize database may be stored separately, e.g., as separate tables in a relational database. It will also be appreciated that other data structures may be employed, e.g., a hash table, an array, linked list, or other conventional data structures. The example table 1000 may include entries 1010 for various tickets. The entries may be indexed by a ticket id, e.g., as a hash index into an array. The ticket id may be the authentication information found on a ticket, or some predetermined function of the authentication information. Alternatively, a separate ticket id field may be used, that is linked to the authentication information. Each entry may also include other information about the ticket with the corresponding ticket id.

Figure 10B:
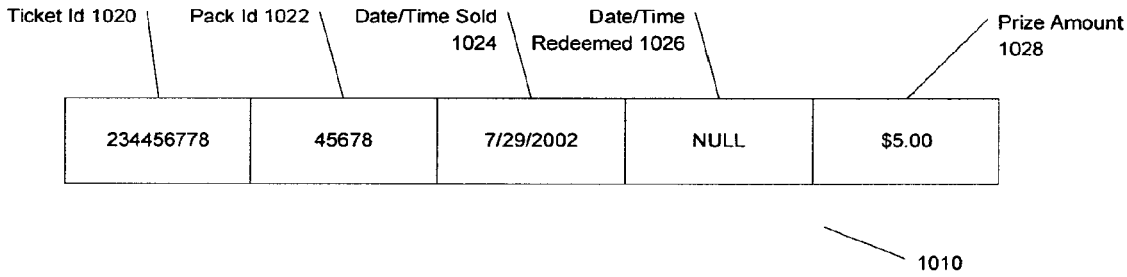
FIG. 10*b* illustrates an example entry in the example ticket information table of FIG. 10*a*, according to an example embodiment of the present invention.

FIG. 10*b* illustrates an example entry in the example ticket information table illustrated in FIG. 10*a*, according to an example embodiment of the present invention. Each entry may include various fields of information for a ticket. It will be appreciated that the various fields need not be stored in a single list or array, but may instead be stored using other arrangements, e.g., in separate normalized tables of a relational database, as a linked data structure, or in some other arrangement. The example entry 1010 may include a ticket id 1020. The ticket id 1020 may be the authentication information located on a ticket, e.g., the concatenation or sum of the two separate machine readable codes found on the ticket illustrated previously. Alternatively, the ticket id 1020 may be some other predetermined function of the authentication information found on the ticket, or may be a separate id field included on the ticket, or may be some other unique index.

The example entry 1010 may also include a pack id 1022. The pack id 1022 may identify the pack, book, or roll from which the ticket with ticket id 1020. The pack id 1022 may be in various forms, e.g., it may be a link to an entry in a pack information table, a numerical id, or some other format.

The example entry 1010 may also include a date/time sold field 1024. This entry may indicate the date and time the ticket was sold, which may be recorded when the ticket is activated if tickets are activated when sold. Any conventional date and time format may be employed.

The example entry 1010 may also include a date/time redeemed field 1026. Here the field is illustrated as NULL, indicating the ticket has not been redeemed. It will be appreciated that, alternatively, a separate flag may be employed to indicate whether the ticket has been redeemed.

The example entry 1010 may also include a prize amount 1028. Here the prize amount shown is $5.00. Any conventional format may be employed. Losing tickets may be included in the table with a "NULL" value. High value tickets may include a "DIVERT" flag in this field, or as a separate field, that indicates the customer should be instructed to go to a lottery service center for redemption.

It will be appreciated that other information may also be included in the ticket information table. For example, the selling price of a ticket may be included, e.g., if a fractional value ticket may be sold. Some tickets may also allow the purchaser to vary the odds by changing the amount spent. Information on this selection may also be included in the ticket information table entries. Information on where a ticket is redeemed may also be included.

It will also be appreciated that a plurality of tickets may be configured in a book or roll, each having a substrate, a game play area located on the substrate, a customer key area located on the substrate, a removable opaque covering applied to the substrate, a first indicia visually indicating whether the game ticket is a winning ticket, the first indicia being located on the substrate within the game play area and concealed by the removable opaque covering, and a second indicia visually indicating whether the game ticket is a winning ticket, the second indicia including a first player key located on the substrate and concealed by the removable opaque covering, and a second player key located on the substrate within the customer key area, wherein whether the game ticket is a winning ticket is determinable using information from the first and second player keys in combination and a position of the first player key within the game play area cannot be determined prior to removal of the removable opaque covering. An exemplary book of tickets may provide that the position of the first player key within the game play area floats from game ticket to game ticket.

MODIFICATIONS

In the preceding specification, the present invention has been described with reference to specific example embodiments thereof. It will, however, be evident that various modifications and changes may be made thereunto without departing from the broader spirit and scope of the present invention as set forth in the claims that follow. The specification and drawings are accordingly to be regarded in an illustrative rather than restrictive sense.

What is claimed is:

1. A method for facilitating the play of a game, comprising:

providing a first player key in a first area of a game ticket;

providing a second player key in a second area of the game ticket;

providing game play information in a game play area on the game ticket;

concealing the first player key and the game play information with a removable opaque coating; and providing a code to at least one of activate, authenticate, and validate the game ticket, the code being concealed by the removable opaque covering, wherein whether the game ticket is a winning ticket is determinable by a player after removal of the removable opaque covering upon visual examination by the player of the first and second player keys in combination, but not separately, and is also determinable by the player after removal of the removable opaque covering upon visual examination of the game play information.

2. The method of claim 1, wherein the first area is located in within the game play area.

3. The method of claim 1, further comprising:

concealing the second player key with the removable opaque coating.

4. The method of claim 1, wherein the game ticket is an instant-win lottery ticket.

5. The method of claim 1, wherein the removable opaque covering is a scratch-off coating.

6. The method of claim 1, wherein whether the game ticket is a winning ticket is determined by:

removing the removable opaque coating of the game play area so that the first player key is exposed; and comparing the first player key with the second player key.

7. The method of claim 1, wherein the game ticket is a winning ticket if the first player key matches the second player key.

8. The method of claim 1, wherein at least one of the first and second player key is a non-numeric and non-alphabetic symbol.

9. The method of claim 1, wherein at least one of the first and second player key is an alphanumeric character.

10. The method of claim 1, further comprising:

providing a prize upon a tendering of a valid winning game ticket for redemption.

11. A method for manufacturing a game ticket, comprising:

providing a first player key in a first area of a game ticket;

providing a second player key in a second area of the game ticket;

providing game play information in a game play area on the game ticket;

concealing the first player key and the game play information with a removable opaque coating; and providing a code to at least one of activate, authenticate, and validate the game ticket, the code being concealed by the removable opaque covering, wherein whether the game ticket is a winning ticket is determinable by a player after removal of the removable opaque covering upon visual examination by the player of the first and second player keys in combination, but not separately, and is also determinable by the player after removal of the removable opaque covering upon visual examination of the game play information.

12. The method of claim 11, wherein the first area is located in within the game play area.

13. The method of claim 11, further comprising:

concealing the second player key with the removable opaque coating.

14. The method of claim 11, wherein the game ticket is an instant-win lottery ticket.

15. The method of claim 11, wherein the removable opaque covering is a scratch-off coating.

16. The method of claim 11, wherein whether the game ticket is a winning ticket is determined by:

removing the removable opaque coating of the game play area so that the first player key is exposed; and comparing the first player key with the second player key.

17. The method of claim 11, wherein the game ticket is a winning ticket if the first player key matches the second player key.

18. The method of claim 11, wherein at least one of the first and second player key is a non-numeric and non-alphabetic symbol.

19. The method of claim 11, wherein at least one of the first and second player key is an alpha-numeric character.

20. The method of claim 11, further comprising:

providing a prize upon a tendering of a valid winning game ticket for redemption.

* * * * *